US005875957A

United States Patent [19]

Yocum

[11] Patent Number: 5,875,957

[45] Date of Patent: Mar. 2, 1999

[54] FOOD SCOOP WITH CONDIMENT COMPARTMENT

[75] Inventor: James A. Yocum, West Chester, Pa.

[73] Assignee: Dopaco, Inc., Exton, Pa.

[21] Appl. No.: 971,620

[22] Filed: Nov. 17, 1997

[51] Int. Cl.[6] ..... B28B 7/24

[52] U.S. Cl. ..... 229/120.22; 229/906; 229/72

[58] Field of Search ..... 229/906, 902, 229/904, 120.22, 400, 120.07, 72, 71

[56] References Cited

U.S. PATENT DOCUMENTS

| | | | |
|---|---|---|---|
| 3,567,105 | 3/1971 | McFarlin . | |
| 4,126,261 | 11/1978 | Cook . | |
| 4,714,190 | 12/1987 | Morrocco | 229/904 X |
| 4,955,528 | 9/1990 | Schluckebier . | |
| 5,540,333 | 7/1996 | Gonzalez et al. . | |
| 5,626,283 | 5/1997 | Mellon . | |
| 5,630,544 | 5/1997 | Shane . | |
| 5,720,429 | 2/1998 | Cordle | 229/904 X |

FOREIGN PATENT DOCUMENTS

| | | | |
|---|---|---|---|
| 34024/93 | 10/1993 | Australia | 229/904 |

*Primary Examiner*—Gary E. Elkins
*Assistant Examiner*—Tri M. Mai
*Attorney, Agent, or Firm*—Dennison, Meserole, Pollack & Scheiner

[57] ABSTRACT

A food container with at least a convex front wall having a single sheet of flexible material edge joined to the inner face of the wall and in intimate contact therewith for a selective inward convex flexing of the sheet a distance determined by the convexity of the first wall to define an upwardly opening pocket therebetween.

12 Claims, 3 Drawing Sheets

FOOD SCOOP WITH CONDIMENT COMPARTMENT

BACKGROUND OF THE INVENTION

The present invention relates to paperboard containers, particularly french fry scoops and the like, wherein a small segregated compartment is provided for a condiment for use with the foodstuff in the scoop or the main compartment thereof.

Inasmuch as containers of this type, normally formed of foldable paperboard, are a single-use product principally used in fast food establishments, and as such containers are used in very large quantities, it is particularly desirable that the costs associated therewith, both in materials and manufacturing, be maintained at a minimum.

The desirability of such containers with separate condiment compartments is well known and exemplified by the following recently issued patents:

| | | |
|---|---|---|
| 4,955,528 | Schluckebier | September 11, 1990 |
| 5,540,333 | Gonzalez et al | July 30, 1996 |
| 5,626,283 | Mellon | May 6, 1997 |
| 5,630,544 | Shane | May 20, 1997 |

In Mellon, the pocket is defined by a rather elaborate extension and modification of the blank, with access to the smaller compartment in the erected container requiring a rather elaborate manipulation thereof including severance along a perforated cut line. Such a manipulation, in light of the highly flexible nature of conventional scoops of this type, could be quite difficult.

The containers in Schluckebier, Gonzales et al, and Shane all disclose separately formed complete condiment pockets or receptacles secured to the principal container.

SUMMARY OF THE INVENTION

It is a primary object of the invention to provide a food container or scoop with an internal condiment chamber which constitutes a significant and practical improvement over known containers of this type. The advantages of the container of the invention result from a unique structural relationship which provides for the formation of the condiment chamber utilizing only minimal material. The procedure for forming and folding the blank basically remains the same as that used in the formation of a conventional scoop, requiring only an additional, although highly unique, step of mounting a single planar sheet to form the pocket which defines the condiment chamber. Thus, substantially no change is required in the manufacturing techniques and apparatus used.

In achieving the objects of the invention, the container is formed from an appropriate foldable sheet material, preferably paperboard, with the blank itself having a configuration which basically follows that of conventional similar containers. The blank, and hence the container, differ in the provision, in one or more of the embodiments to be disclosed, of a unique recess or aperture adjacent the upper edge of the front wall for facilitating access to the condiment chamber formed immediately inward thereof. Of significance with regard to the overall configuration of the blank is the capability of utilizing conventional blank forming and folding apparatus and the avoidance of an increase in the actual material of the blank.

The pocket defining the condiment chamber consists solely of the inner surface of the front wall and a single flat or planar sheet of flexible material, preferably a transparent thin synthetic resinous material such as acetate, Mylar, polyethylene, and the like. This single pocket sheet of material is positioned on the inner face of the front wall of the container prior to a folding of the blank and in face-to-face engagement therewith. The upper edge of the pocket sheet is generally aligned with the upper edge of the container wall, with the opposed side edge portions and the lower edge portion of the sheet bonded, normally by an appropriate adhesive, to the inner face of the container front wall. The upper edge portion of the sheet remains free, that is unsecured.

In use, upon a folding of the container blank to a position for the reception of foodstuffs, the front wall thereof automatically assumes a convex configuration which inherently brings the opposed side edges of the pocket sheet laterally inward toward each other, either following and lying against the inner concave curvature of the front wall, or inwardly arcing away from the front wall along a curvature which generally mirrors the curvature of the front wall to provide the desired pocket. Should the pocket sheet tend to follow the curvature of the front wall, the pocket sheet, when the condiment is to be introduced, can merely be moved inwardly by a finger or, more likely, by the spout or nozzle of the condiment container moving inwardly thereagainst either over the upper edge of the front wall or through an appropriate recess or opening in the front wall adjacent the upper edge thereof.

The formed pocket only requires a flat pocket sheet secured flat on the inner face of the container wall. The pocket sheet is not folded, does not include side walls and opens either automatically or by the mere introduction of the discharge nozzle of a condiment container. The actual mounting of the pocket sheet to the blank requires minimal apparatus and does not interfere with the conventional folding operation for the container itself. Similarly, the material of the pocket sheet, while liquidproof for at least a limited time period, can be of any of a number of extremely inexpensive materials which require no preparation, prefolding, or the like. Similarly, the actual size of the condiment pocket can vary by merely changing the width and/or height of the pocket sheet.

Other features of the invention will become apparent from the more detailed description of the invention following hereinafter.

DESCRIPTION OF PREFERRED EMBODIMENTS

Figure 1:
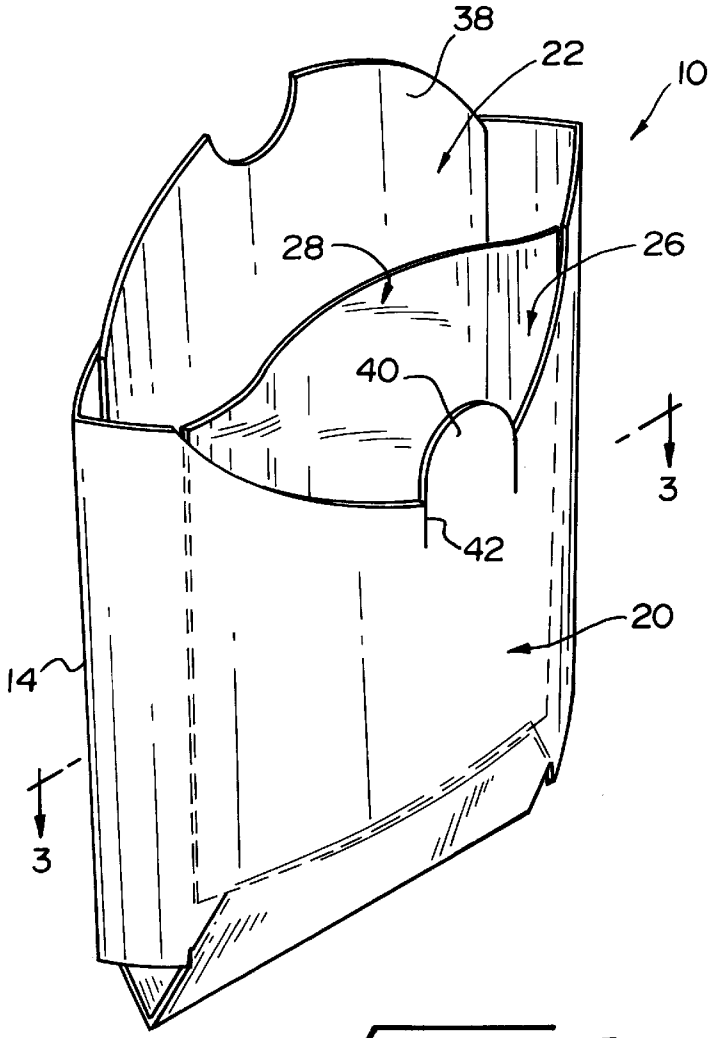
FIG. 1 is a perspective view of a partially open container formed in accord with the present invention with the condiment pocket also partially open.
Figure 2:
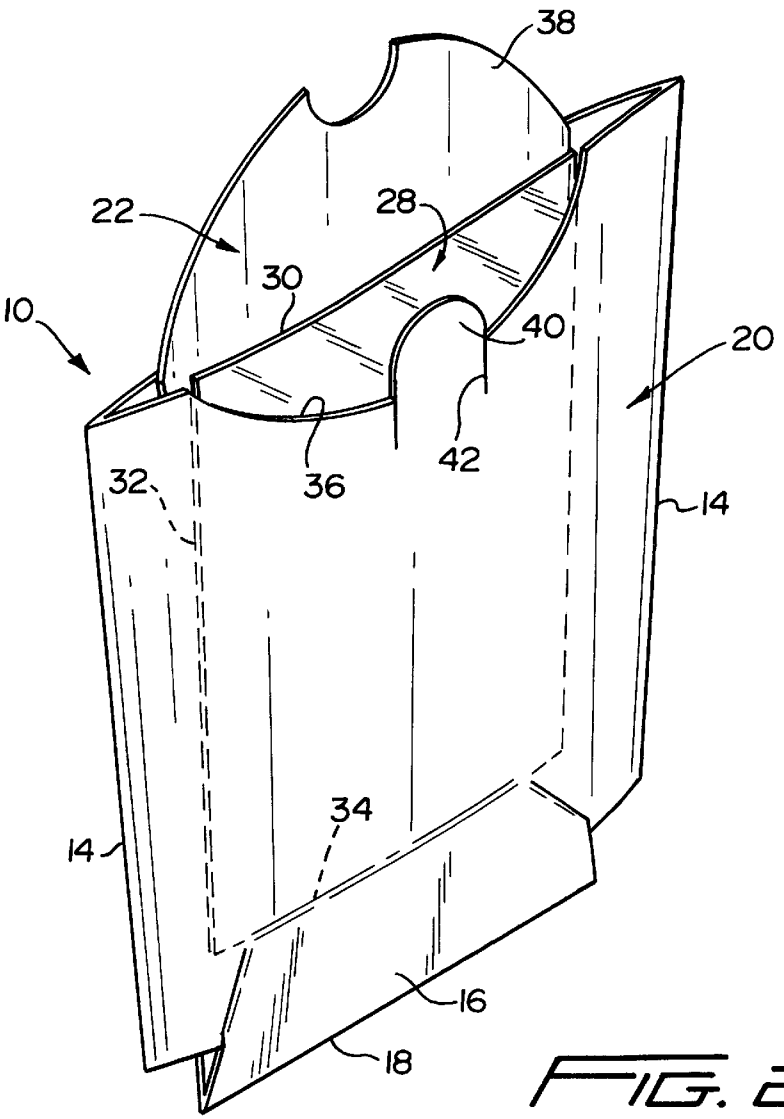
FIG. 2 is a perspective view of the container collapsed for shipping and storage with the pocket sheet in a planar position therein.

Referring now more particularly to the drawings, FIGS. 1–4 illustrate a collapsible and selectively expandable container or carton 10 folded from a blank 12 of paperboard or the like. The container 10, after an appropriate folding of the blank 12, will normally be shipped and stored in the collapsed position thereof, as illustrated in FIG. 2, and will be expanded prior to filling by merely applying inward pressure on the opposed side edges 14 thereof and upward pressure on the bottom panels 16 along a fold line 18 defined therebetween. FIG. 1 illustrates the container 10 partially open.

Figure 3:
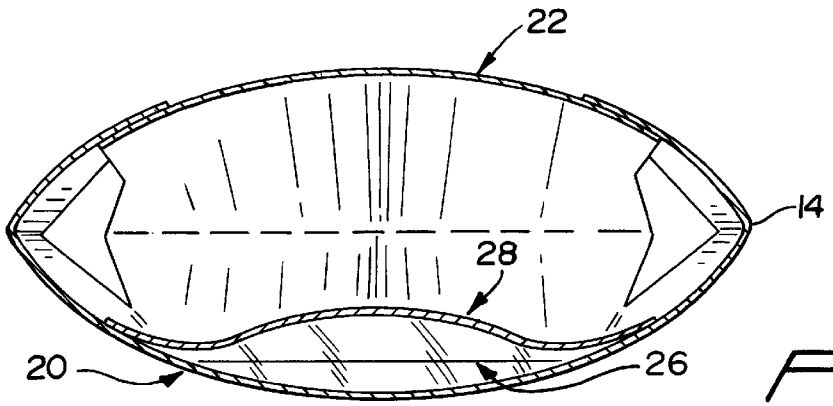
FIG. 3 is a transverse cross section view taken substantially on a plane passing along line 3—3 in FIG. 1.

As the side edges 14 are moved inwardly toward each other, the front and rear walls 20 and 22 have the effective width thereof shortened with the walls bowing outward relative to each other and presenting opposed convex configurations, note in particular FIG. 3.

Figure 4:
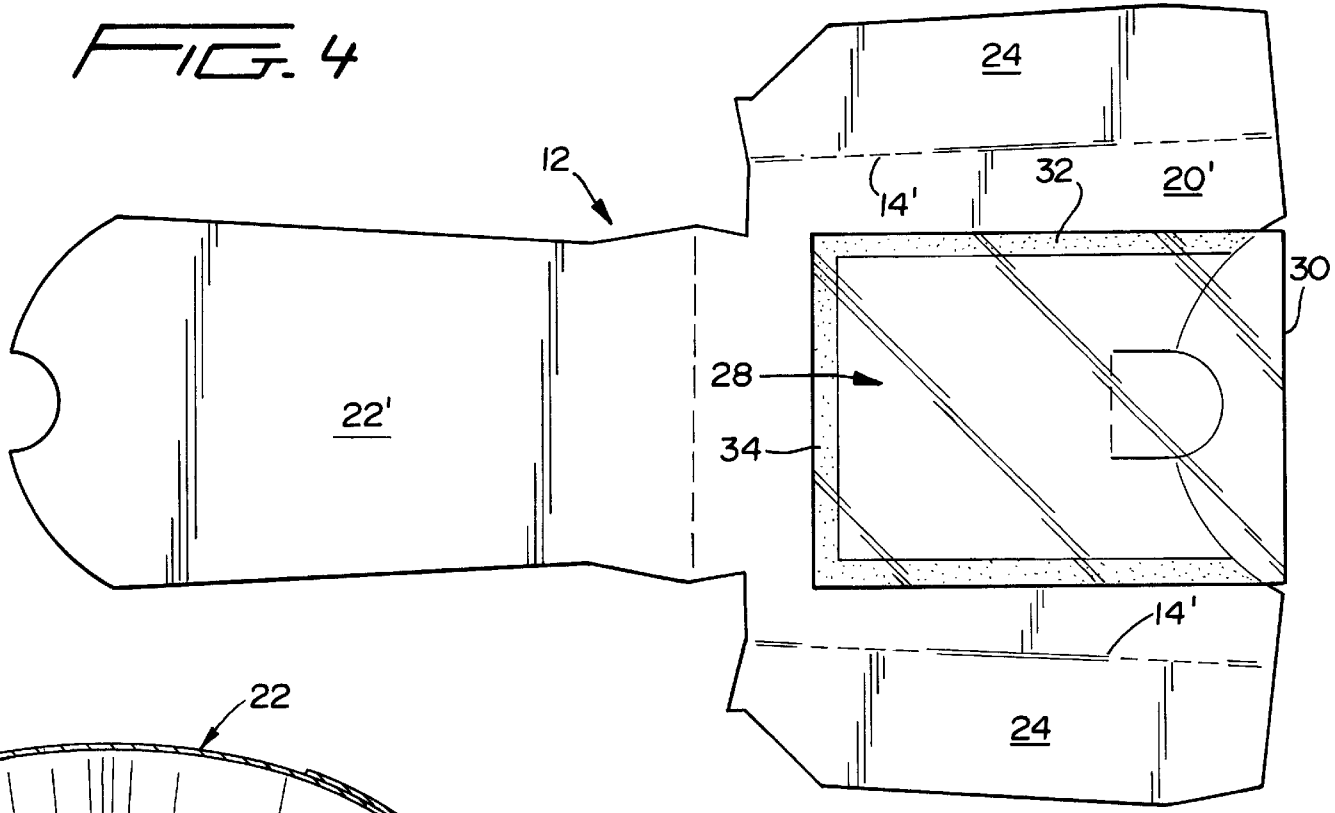
FIG. 4 is a plan view of a blank from which the container is folded.

Noting the blank 12 in FIG. 4, it will be recognized that the front wall 20 is formed by a front wall panel 20' having opposed full height side flanges 24 joined thereto along fold lines 14' which define the opposed edges 14 of the folded container 10. Upon a folding of the unitary blank 12, the side flanges 24 are adhesively secured to the opposed edge portions of a rear wall panel 22' and combined therewith to form the rear wall 22 of the container 10.

The above construction is substantially conventional. It is a primary purpose of the invention to provide this basic construction with a condiment pocket 26, that is a pocket specifically adapted to form a chamber for the reception of a condiment to be used in conjunction with foodstuffs contained within the container or main chamber thereof.

The pocket 26 is simply although uniquely formed utilizing a single flat sheet 28 of flexible material, preferably of an appropriate waterproof or moisture proof synthetic resinous material. This pocket sheet 28 is positioned flat against the inner face of the front wall panel 20' and is in face-to-face engagement therewith. The planar pocket sheet 28, preferably rectangular, has a free upper edge 30, opposed side edges or edge portions 32 adhesively bonded to the front wall panel 20', and a bottom edge or edge portion 34 also adhesively bonded to the front wall panel 20'. The adhesive bonding extends continuously along the opposed side edges 32 and bottom edge 34 for a continuous sealing of these edges. The pocket sheet 28 retains its planar shape as the blank is folded to form the container 10 in the collapsed a position of FIG. 2.

The pocket chamber is formed only as the opposed side edges 14 of the collapsed container are moved inwardly toward each other to erect the container for the reception of foodstuffs. Upon doing so, the opposed side edges 32 of the pocket sheet 28 are, in effect, moved laterally toward each other, requiring a convex forming of the sheet 28 therebetween, preferably in opposition to the convex forming of the container front wall 20. Should the sheet 28 tend to follow the convex configuration of the front wall 20, the sheet 28 can be inwardly flexed by merely a flick of the fingers or the introduction of the nozzle of a condiment container. As will be seen from the drawings, the upper openable edge 30 of the pocket sheet 28 generally aligns with the upwardly opening mouth of the container and along the upper extremity of the front wall 20. This front wall 20 may have the upper edge 36 thereof formed with a concave central portion which facilitates access to the pocket 26 and allows for the simultaneous formation, in adjacent blanks, of a scoop-like extension 38 on the rear wall 22. The pocket sheet 28 extends across the forwardly opening area defined by the concave upper edge portion 36 of the front wall 20 allowing for a direct engagement of the discharge nozzle of a condiment container thereagainst for a filling of the pocket chamber and, if necessary, a simultaneous inward flexing of the pocket sheet 28.

Noting FIGS. 1 and 2 in particular, the front wall 20 can include a central coplanar upwardly projecting tab 40 centrally positioned and extending above the concave upper edge portion 36. The tab, through opposed cut lines 42 defining continuations of the opposed edges of the tab 40, will actually extend a relatively short distance into the front wall 20 below the upper edge portion 36 whereby, upon a manual downward and outward pulling of the tab 40, a recess is defined for properly accommodating the discharge nozzle of a condiment dispenser and facilitating the orientation thereof for introduction of the condiment into the pocket 26.

Figure 6:
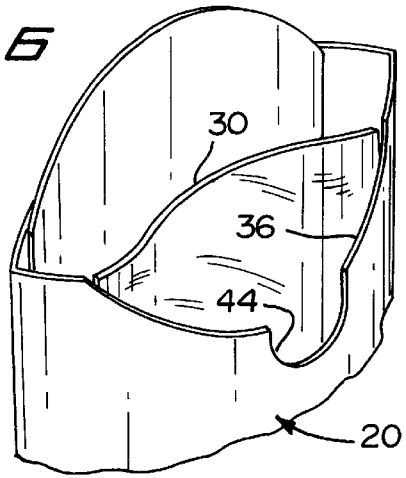
FIG. 6 illustrates a further variation wherein the front wall includes an upwardly opening recess.
Figure 7:
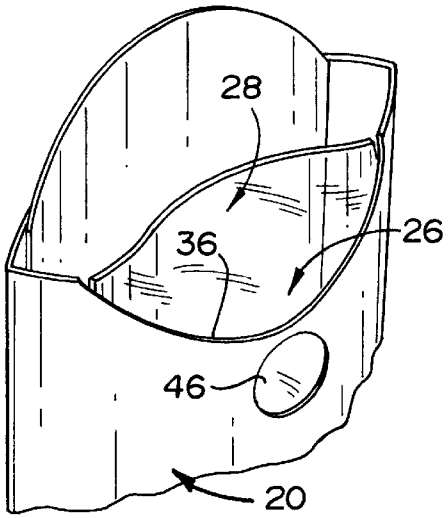
FIG. 7 is a further variation wherein the front wall includes a filling aperture therethrough immediately below the upper edge.
Figure 5:
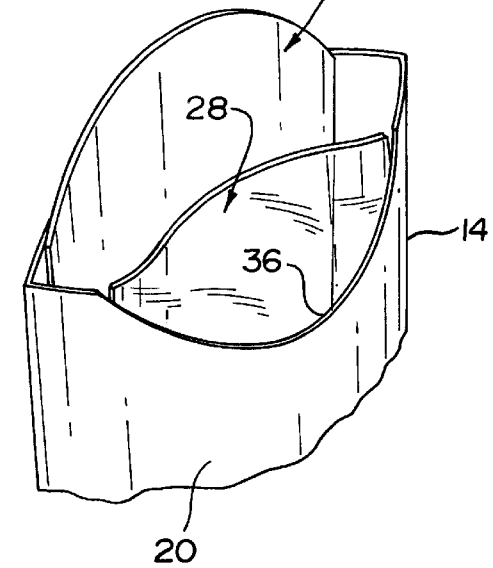
FIG. 5 illustrates a variation in the upper edge of the front wall adjacent the formed pocket.

As will be noted in FIG. 5, the tab can be eliminated, with reliance for a guided introduction of the dispensing nozzle being provided by the concave upper edge portion itself. As seen in FIG. 6, the tab can be replaced by a permanently defined recess 44 or, noting FIG. 7, by an opening 46 through the front wall immediately below the upper edge 36.

Figure 8:
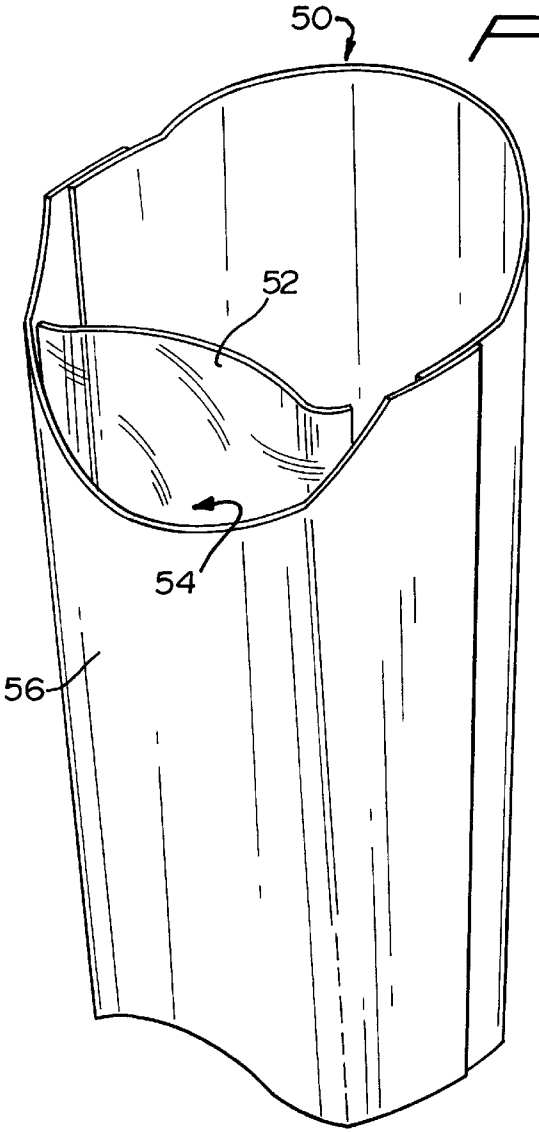
FIG. 8 is a perspective view wherein the container, after a folding of the blank, is preformed, as opposed to the previously illustrated collapsible container, thus illustrating the application of the inventive concepts of the invention thereto.

Referring now to FIG. 8, the basic container 50 illustrated therein is of the type which, while formed from a unitary blank similar to the blank 12, is erected in a former to the expanded shape thereof, then glued and packed by nesting in multiple similarly formed containers or cartons, providing in effect a stack of preformed cartons. Such containers 50, prior to the final forming thereof and preferably on the blank prior to folding, will similarly be provided with a single planar pocket sheet 52, positioned and mounted in the same manner as sheet 28 to similarly define the desired open mouth condiment pocket,, upon the convex forming of the container front wall 56. As will be appreciated, the upper edge of the front wall 56 can be provided with any of the before described configurations and access enhancing features.

While the pocket 26 has been defined as formed in conjunction with the front wall, and in particular with the inner face thereof, should it be necessary or desirable, the single flat pocket sheet 28 can be secured to the inner face of the rear wall to provide the pocket thereat in a manner as described above.

The foregoing is illustrative of the features of the invention. While several fairly closely related embodiments have been illustrated, it is to be appreciated that other embodiments, as they fall within the parameters of the claims appearing hereinafter, are also considered to be within the scope of the invention.

I claim:

1. In a food container formed from a unitary blank of foldable sheet material, said container comprising first and second opposed upstanding walls, opposed sides extending between and joining said walls, and a bottom extending between and joining said walls, said walls and sides having upper edges defining an upwardly opening container mouth; the improvement comprising a condiment pocket on said first wall, said first wall having an inner surface, a single pocket sheet of flexible transparent material overlying said inner surface and in surface-to-surface contact with a portion of the inner surface dimensionally substantially equal to said pocket sheet, said pocket sheet having opposed side edges, a bottom edge and a top edge, said opposed side edges and said bottom edge being directly bonded to said inner surface, said top edge being free of said inner surface, said first wall, in an open position of said container for the reception of foodstuffs, being outwardly convex relative to said second wall with said inner surface thereof being concave, wherein the transverse distance between said opposed side edges of said Pocket sheet is effectively reduced, allowing said pocket sheet to flex inwardly away from said concave inner surface between the opposed bonded edges of said pocket sheet to define said pocket.

2. In a food container formed from a unitary blank of foldable sheet material, said container comprising first and second opposed upstanding walls, opposed sides extending between and joining said walls, and a bottom extending between and joining said walls, said walls and sides having upper edges defining an upwardly opening container mouth; the improvement comprising a condiment pocket on said first wall, said first wall having an inner surface, a single pocket sheet of flexible material overlying said inner surface and in surface-to-surface contact with a portion of the inner surface dimensionally substantially equal to said pocket sheet, said pocket sheet having opposed side edges, a bottom edge and a top edge, said opposed side edges and said bottom edge being directly bonded to said inner surface, said top edge being free of said inner surface, the upper edge of said first wall having a central concave extent generally aligned with said pocket sheet between the bonded side edges thereof, the top edge of said pocket sheet being substantially linear and extending across said concave extent of the upper edge of said first wall in generally upwardly spaced relation thereto for free access to said pocket sheet over said first wall upper edge, said first wall, in an open position of said container for the reception of foodstuffs, being outwardly convex relative to said second wall with said inner surface thereof being concave, wherein the transverse distance between said opposed side edges of said pocket sheet is effectively reduced, allowing said pocket sheet to flex inwardly away from said concave inner surface between the opposed bonded edges of said pocket sheet to define said pocket.

3. The container of claim 2 wherein said first wall, on the top edge thereof and centrally of the concave extent, includes a vertically extending tab coplanar therewith and projecting centrally above the concave extent, said tab having opposed side edges above the concave extent and extending downwardly into the first wall by defined cut lines in said front wall wherein said tab is downwardly foldable outward of said first wall and below said concave extent and defines a receiving notch for the introduction of a condiment into said pocket.

4. The container of claim 2 wherein said concave extent includes a central recess therein extending downward into said first wall wherein an access means is defined for the introduction of a condiment into said pocket.

5. The container of claim 2 including an aperture in said first wall spaced immediately below said concave extent and in alignment with said pocket to define an access means for the introduction of a condiment into said pocket.

6. The container of claim 2 wherein said pocket sheet is transparent.

7. In a food container formed from a unitary blank of foldable sheet material, said container comprising first and second opposed upstanding walls, opposed sides extending between and joining said walls, and a bottom extending between and joining said walls, said walls and sides having upper edges defining an upwardly opening container mouth; the improvement comprising a condiment pocket on said first wall, said first wall having an inner surface, a single pocket sheet of flexible material overlying said inner surface and in surface-to-surface contact with a portion of the inner surface dimensionally substantially equal to said pocket sheet, said pocket sheet having opposed side edges, a bottom edge and a top edge, said opposed side edges and said bottom edge being directly bonded to said inner surface, said top edge being free of said inner surface, said first wall comprising a front wall of the container, said second wall comprising a rear wall of the container, said rear wall having an upper edge vertically above the upper edge of said front wall, said front wall, in an open position of said container for the reception of foodstuffs, being outwardly convex relative to said rear wall with said inner surface thereof being concave, wherein the transverse distance between said opposed side edges of said pocket sheet is effectively reduced, allowing said pocket sheet to flex inwardly away from said concave inner surface between the opposed bonded edges of said pocket sheet to define said pocket.

8. A food container comprising opposed first and second walls, opposed sides extending between and joining said walls, and a bottom, said first and second walls having top edges defining an open container mouth, said first wall being outwardly convex relative to said second wall and including a concave inner surface, a single flexible pocket sheet engaged in surface-to-surface contact with a substantially coextensive portion of the concave inner surface of said first wall at and immediately below said top edge of said first wall, said pocket sheet having opposed side edges and a bottom intimately joined to said first wall inner surface and a free upper edge generally aligned with and adjacent said top edge of said first wall, said pocket sheet being selectively inwardly flexed relative to said inner surface of said first wall and defining a generally convex configuration opposed from and inward of the convex first wall, to form a pocket, said first wall, below the top edge thereof and below the free upper edge of said pocket sheet, having an access opening defined therein and communicating with said pocket.

9. The container of claim 8, wherein said access opening is defined by a folding tab formed in said first wall, adjacent the top edge thereof, with opposed cut lines, one to each side of said tab and extending inward of said first wall from said top edge thereof wherein said tab is downwardly foldable below said top edge and between said cut lines to define said access opening to said pocket.

10. A food container comprising opposed first and second walls, opposed sides extending between and joining said walls, and a bottom, said first and second walls having top edges defining an open container mouth, said first wall being outwardly convex relative to said second wall and including a concave inner surface, a single flexible pocket sheet engaged in surface-to-surface contact with a substantially coextensive portion of the concave inner surface of said first wall at and immediately below said top edge of said first wall, said pocket sheet having opposed side edges and a bottom intimately Joined to said first wall inner surface and a free upper edge generally aligned with and adjacent said top edge of said first wall, said pocket sheet being selectively inwardly flexed relative to said inner surface of said first wall and defining a generally convex configuration opposed from and inward of the convex first wall, said top edge of said first wall including a central concave extent substantially coextensive with said pocket sheet between the opposed side edges thereof, said upper edge of said pocket sheet being in generally upwardly spaced relation above said first wall concave extent.

11. The container of claim 10 wherein said first wall, adjacent said concave extent, includes an access opening therethrough communicating with said pocket.

12. For use in the forming of an upwardly opening food container with a condiment pocket, a unitary folding blank comprising longitudinally aligned first and second wall panels with a bottom panel section defined therebetween, said wall panels each having an outer edge and being foldable about said bottom panel section to position said outer edges in general overlying alignment with each other, and side panels adapted to engage and join said first and second wall panels upon a folding thereof, a single planar sheet of flexible material overlying and coextensive with an equally dimensioned corresponding portion of said first wall panel, said sheet having an unsecured upper edge generally aligned along the outer edge of said first wall panel, opposed side edges secured to said first wall panel, a bottom edge secured to said first wall panel wherein, upon a convex flexing of said first wall panel about an axis generally parallel to said opposed side edges of said sheet, said opposed side edges will effectively move transversely toward each other and reduce the transverse distance therebetween wherein a convex flexing of said sheet relative to said first wall panel is achieved, and means defined by said first wall panel for forming access therethrough to said overlying planar sheet below said upper edge of said sheet.

* * * * *